US005730296A

United States Patent [19]

Limmer

[11] Patent Number: 5,730,296

[45] Date of Patent: Mar. 24, 1998

[54] READY TO STOCK MULTIPLE PRODUCT PACKAGE

[75] Inventor: William E. Limmer, Los Alamitos, Calif.

[73] Assignee: Emhart Inc., Newark, Del.

[21] Appl. No.: 853,766

[22] Filed: May 9, 1997

[51] Int. Cl.[6] ..... B65D 25/38

[52] U.S. Cl. ..... 206/738; 206/580; 206/806

[58] Field of Search ..... 206/736, 738, 206/739, 745, 756, 763, 772, 774, 436, 775, 499, 804, 806, 580

[56] References Cited

U.S. PATENT DOCUMENTS

| | | | |
|---|---|---|---|
| 3,313,407 | 4/1967 | Palm, Jr. | 206/806 X |
| 3,952,872 | 4/1976 | Consiglio, Jr. | 206/806 X |
| 4,072,232 | 2/1978 | Marsman et al. | 206/806 X |
| 4,111,297 | 9/1978 | Paulin | 206/739 |
| 4,363,405 | 12/1982 | Christie | 206/774 |
| 4,484,681 | 11/1984 | Consiglio, Jr. | 206/745 |

*Primary Examiner*—Jacob K. Ackun
*Attorney, Agent, or Firm*—Spencer T. Smith

[57] ABSTRACT

A ready to stock multiple product package has upper and lower box portions. The upper box portion has an open bottom and the lower box portion has an open top. The lower box portion is selectively sized so that it can be slidingly inserted into the upper box portion to close the open bottom of the upper box portion. A plurality of identical product packages are contained within the lower box portion, each of which has a spike receiving hole proximate its top. The product packages are arranged so that the holes are in line. By holding the lower box portion in one hand, the spike can be passed through a notch in the top edge of the lower box portion and sequentially through the in line spike receiving holes of the individual packages whereupon the lower box portion can be lowered to separate the lower box portion from the individual packages.

3 Claims, 1 Drawing Sheet

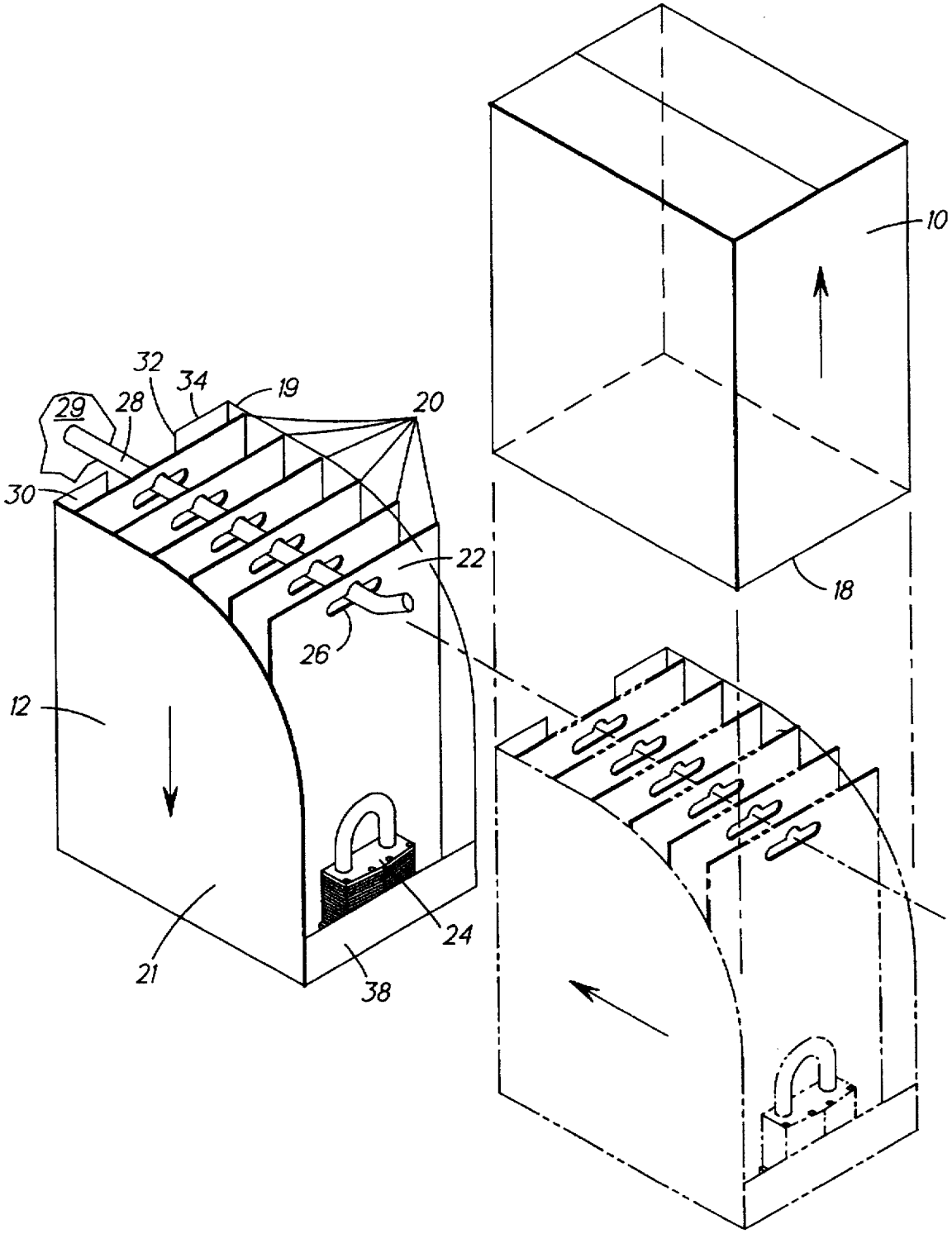
10
18
32
34
19
20
29
28
30
22
26
12
24
21
38

READY TO STOCK MULTIPLE PRODUCT PACKAGE

The present invention relates to a shipping box which is filled with a plurality of spike mounted cards to which product is secured and which is configured for facilitating the placement of the mounting cards on a wall spike or the like.

BACKGROUND OF THE INVENTION

Product is often stocked in a retail store by hanging a card, to which a unit of the product is secured by shrink wrap or the like, on a horizontally extending spike. A multiple number of units is delivered to the store in a box. The box is opened by a stock person and, one by one, the cards, which have a hole proximate the top, are placed on the horizontally extending spike.

OBJECT OF THE INVENTION

It is an object of the present invention to increase the productivity of the stock person.

Other objects and advantages of the present invention will become apparent from the following portion of this specification and from the accompanying drawings which illustrate in accordance with the mandate of the patent statutes a presently preferred embodiment incorporating the principles of the invention.

BRIEF DESCRIPTION OF THE DRAWINGS

Referring to the drawings:

The sole FIGURE is an oblique view of an upper box portion and a separated lower box portion supporting a multiple number of individual product packages which have been pushed onto a wall spike.

BRIEF DESCRIPTION OF THE PREFERRED EMBODIMENT

The shipment box has an upper portion 10 and a lower portion 12. The upper box portion has a top which may be closed in a conventional manner with inner (not shown) and outer 14 flaps. The bottom 18 of the upper box portion is open (there are no closure flaps) and telescopically receives the lower box portion 12 which is open at the top 19 and which holds a number of individual packages 20 (the bottom 21 of the lower box portion closes the opening at the bottom of the upper box portion). As shown, each package has a card 22 to which product 24 (here a padlock) is secured with shrink wrap. The cards, which stand vertically in the lower box portion, have a hole 26 proximate the top, for receiving a stocking spike 28 projecting horizontally from a store wall or the like 29. The back wall 30 of the lower portion of the box has a notch 32 defined in its top edge 34 so that a spike can be passed through the spike receiving holes in the packages.

To stock these packages, a stock person pulls the upper portion of the box up away from the lower box portion fully separating the box portions. The top portion can now be discarded. Now, the stock person can, by holding the lower box portion to present the holes of the packages in line with the spike, sequentially locate all of the packages on the spike (the spike will pass through the notch in the back wall of the lower box portion and sequentially through the spike receiving holes in the packages). With all of the packages on the spike, the stock person can then lower the lower box portion removing the hanging packages from the lower box portion. The front 36 of the lower box portion can be substantially open (in the preferred embodiment there is a short vertical lip 38 at the bottom of the front wall to contain the packages) so that the stock person can easily compress the packages at the top to speed up the process of inserting the spike through the package holes.

What is claimed is:

1. A ready to stock multiple product package comprising upper and lower box portions, said upper box portion having an open bottom and said lower box portion having an open top, said lower box portion being selectively shaped so that it can be slidingly inserted into said upper box portion to close the open bottom of said upper box portion, a plurality of identical product packages contained within said lower box portion, each of said product packages having a spike receiving hole proximate the top thereof and said product package being arranged so that said holes are in line, and a notch extending downwardly from the top of said lower box portion and located to be in line with said in line spike receiving holes in said product packages, so that the upper box portion can be pulled away from said lower box portion to expose the product packages whereby, by holding the lower box portion in one hand the spike can be passed through the notch and sequentially through the in line spike receiving holes of the individual packages whereupon the lower box portion can be lowered to remove the individual packages from said lower box portion.

2. A ready to stock multiple product package according to claim 1, wherein said lower box portion has a substantially open portion in front of said packages so that the front package can be pushed rearwardly.

3. A ready to stock multiple product package according to claim 2, wherein each of said packages includes a padlock.

* * * * *